United States Patent [19]

Thurman

[11] 4,106,624

[45] Aug. 15, 1978

[54] TRAY STRUCTURE

[75] Inventor: Paul G. Thurman, West Liberty, Ohio

[73] Assignee: Dare Pafco, Inc., Urbana, Ohio

[21] Appl. No.: 798,339

[22] Filed: May 19, 1977

[51] Int. Cl.[2] ..... B65D 21/04

[52] U.S. Cl. ..... 206/507

[58] Field of Search ..... 206/505, 506, 507, 518

[56] References Cited

U.S. PATENT DOCUMENTS

| | | | |
|---|---|---|---|
| 3,409,163 | 11/1968 | Lockwood | 206/505 |
| 3,675,815 | 7/1972 | Rehrig | 206/507 |
| 3,780,905 | 12/1973 | Herolzer | 206/507 |
| 3,865,239 | 2/1975 | Herolzer | 206/507 |
| 3,870,151 | 3/1975 | Johnson | 206/507 |
| 4,023,680 | 5/1977 | Thurman | 206/507 |

*Primary Examiner*—George E. Lowrance
*Attorney, Agent, or Firm*—Wood, Herron & Evans

[57] ABSTRACT

An improved square tray structure in which a series of trays can be stacked one on top another when the trays are loaded, and which can be nested one within another when the trays are empty. The tray's end walls are of a height about one-half that of the tray's side walls, the end and side walls all extending up from the tray's floor. The tray's floor is positioned closely adjacent the tray's bottom edges. The tray's side walls each include a top rail and a top rib extending along the top edge thereof, and a bottom rail extending along the bottom edge thereof, the rails and rib being linear and extending from adjacent one end to the other of the side wall. The tray's end walls each include a middle rail and a middle rib extending along the top edge thereof from adjacent one end to the other of the end wall. In use, and when the trays are stacked, the trays' side walls are oriented into a vertical coplanar attitude so that a bottom rail of an upper tray seats on a top rib and rail of a lower tray on each side thereof for supporting the trays in that stacked relation. When the trays are nested, the upper tray is rotated 90° relative to the lower tray so that the upper tray's bottom rails seat on the lower tray's middle ribs and rails, and so that the upper tray's middle rails seat on the lower tray's upper ribs and rails, for supporting the trays in that nested relation. The top, middle and bottom rib and rail structures cooperate with the trays' walls to prevent end-to-end, as well as side-to-side, movement of the upper tray relative to the lower tray when the trays are in stacked, as well as in nested, relationship with one another.

18 Claims, 11 Drawing Figures

TRAY STRUCTURE

This invention relates to trays. More particularly, this invention relates to trays of the type which may be stacked on top of one another when loaded, and that may be nested within one another when empty.

Trays are commonly used in the bakery industry in the transporting of baked goods within the bakery, or between the bakery and the sales outlet. Typically, such trays are used in connection with the transporting or the temporary warehousing of, e.g., pies.

Many tray structures are known to the prior art. Indeed, the tray art is a highly developed art. It is known to the prior art, for example, to provide a tray structure in which trays may be stacked one upon the other in the use attitude, and may be nested one within another in a storage attitude. The trays are usually stacked upon one another in the use attitude when the trays are loaded with, e.g., bakery product. In this use attitude, the floors of the trays are spaced a substantial distance one from the other, that distance being sufficient to accommodate, e.g., pies, rolls, or the like in the baking industry. However, it is desirable to translate those trays into the storage attitude when the trays are empty. In the storage attitude, the trays are nested together one within another so that the floors are closely adjacent, i.e., so that no substantial space is present between an upper tray's floor and a lower tray's floor. As a practical matter, therefore, a given number of trays nested one within another takes substantially less spatial volume than do those same trays if stacked one upon another. This reduction in spatial volume is highly desirable in the baking industry in that it permits the same number of trays to be returned to a supply source from a delivery site in a smaller spatial volume than was required for initial delivery of the bakery products from the manufacturing site to the delivey site. In other words, and in the same space, a substantially greater number of trays can be returned when nested together one with another than can be initially transported when stacked one on top of the other. Such promotes economic efficiency in freight costs of products shipped on the trays.

It has been the primary objective of this invention to provide an improved and novel tray structure in which successive upper and lower square trays of identical structural configuration may be either stacked one on top the other or nested one within another, as is desired by the user, the improved and novel tray being structured so as to permit economical fabrication while retaining adequate tray strength characteristics to provide a commercially acceptable useful life for the tray.

In accord with this objective, the improved and novel tray structure of this invention is directed to a square tray structure in which a series of trays can be stacked one on top another when the trays are loaded, and which can be nested one within another when the trays are empty. The tray's end walls are of a height about one-half that of the tray's side walls, the end and side walls all extending up from the tray's floor. The tray's floor is positioned closely adjacent the tray's bottom edges. The tray's side walls each include a top rail and a top rib extending along the top edge thereof, and a bottom rail extending along the bottom edge thereof, the rails and rib being linear and extending from adjacent one end to the other of the side wall. The tray's end walls each include a middle rail and a middle rib extending along the top edge thereof from adjacent one end to the other of the end wall. In use, and when the trays are stacked, the trays' side walls are oriented into a vertical coplanar attitude so that a bottom rail of an upper tray seats on a top rib and rail of a lower tray on each side thereof for supporting the trays in that stacked relation. When the trays are nested, the upper tray is rotated 90° relative to the lower tray so that the upper tray's bottom rails seat on the lower tray's middle ribs and rails, and so that the upper tray's middle rails seat on the lower tray's upper ribs and rails, for supporting the trays in that nested relation. The top, middle and bottom rib and rail structures cooperate with the trays' walls to prevent end-to-end, as well as side-to-side, movement of the upper tray relative to the lower tray when the trays are in stacked, as well as in nested, relationship with one another.

Other objectives and advantages will be more apparent from the following detailed description taken in conjunction with the drawings in which.

Figure 4:
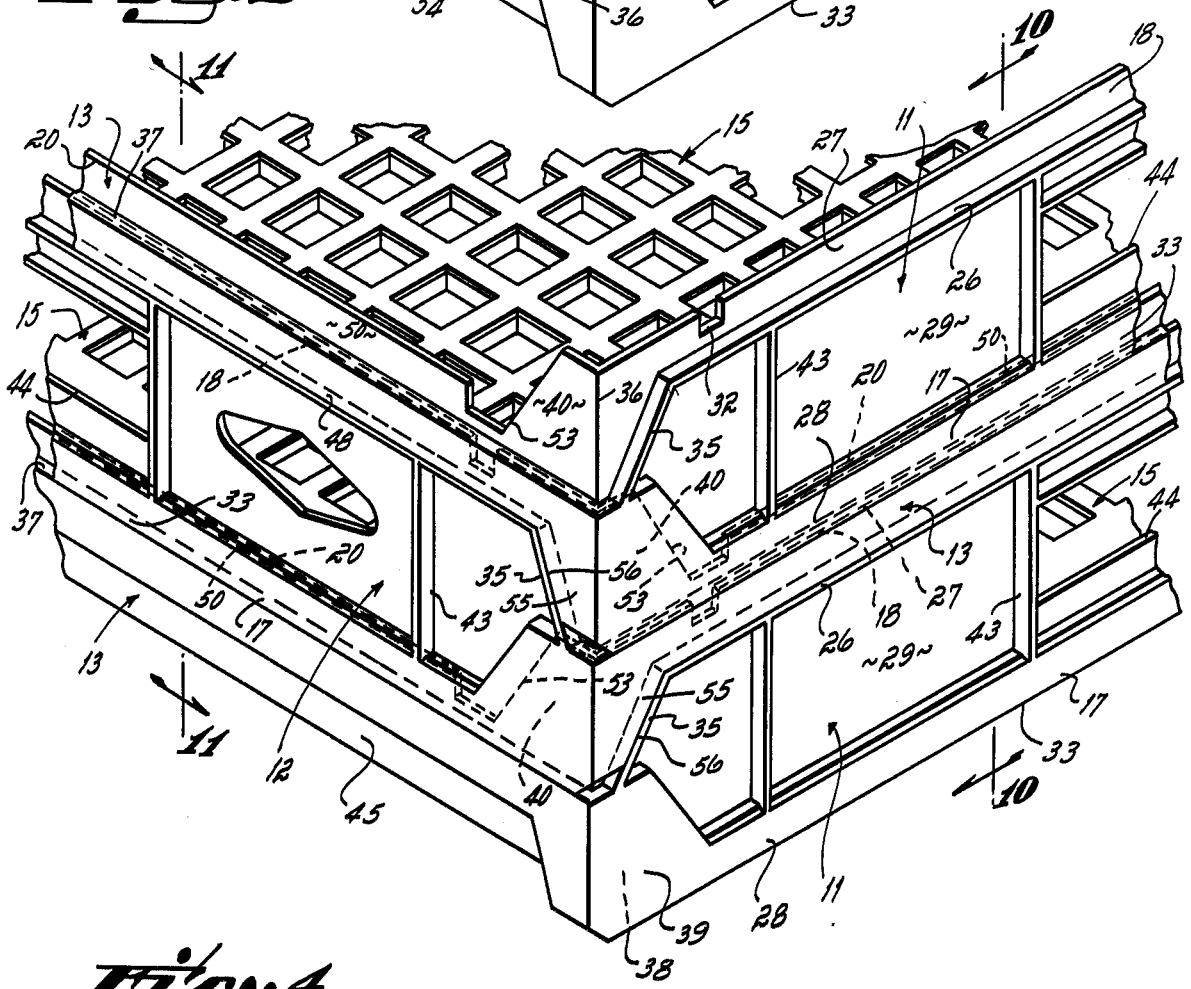
FIG. 4 is a perspective view similar to FIG. 3 illustrating three trays, each in accord with the principles of this invention, in nested relation one with another.
Figure 5:
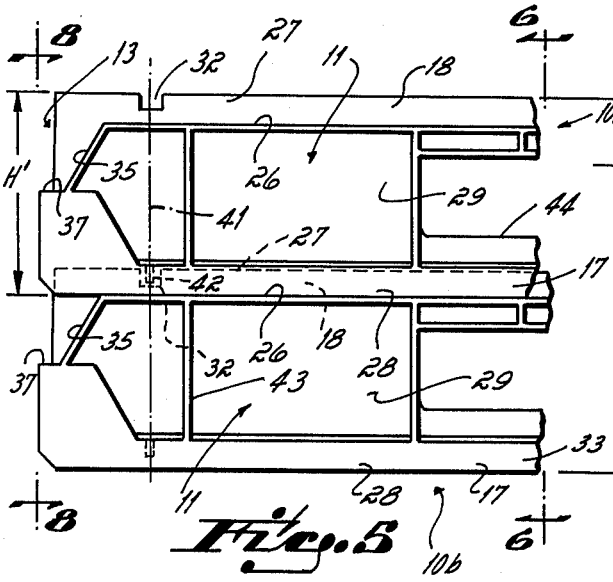
FIG. 5 is a side plan view illustrating two trays in stacked relation one with another.
Figure 8:
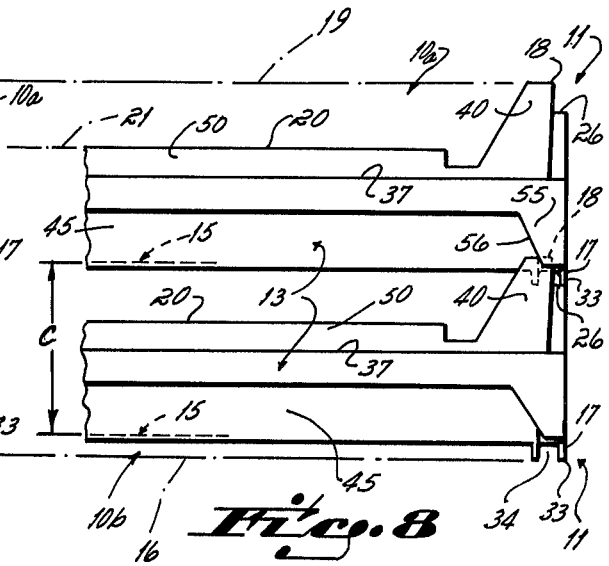
FIG. 8 is an end plan view taken along line 8—8 of FIG. 5.
Figure 9:
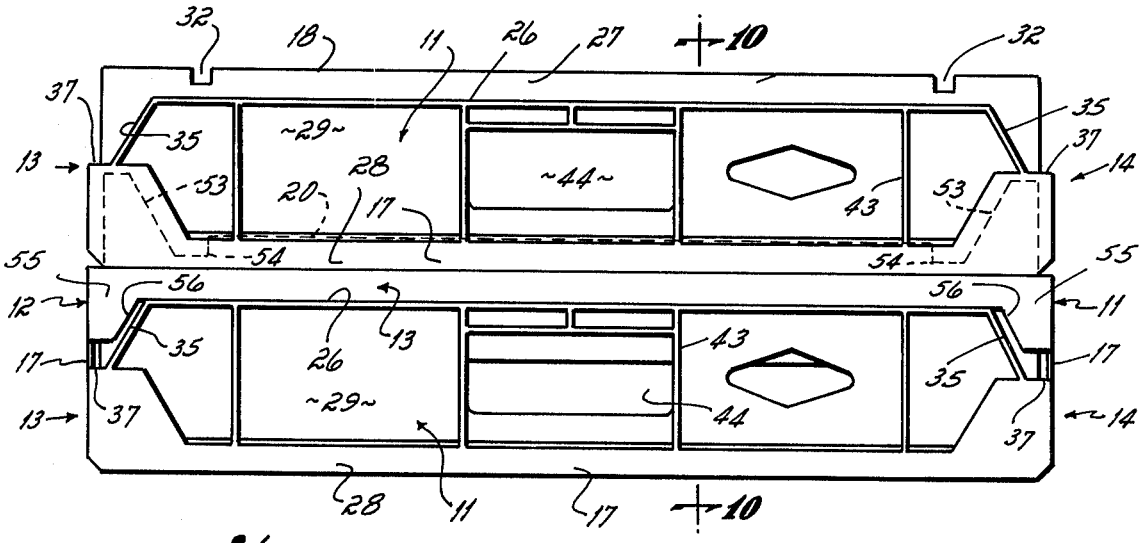
FIG. 9 is a side plan view illustrating three trays in nested relation one with another.
Figure 10:
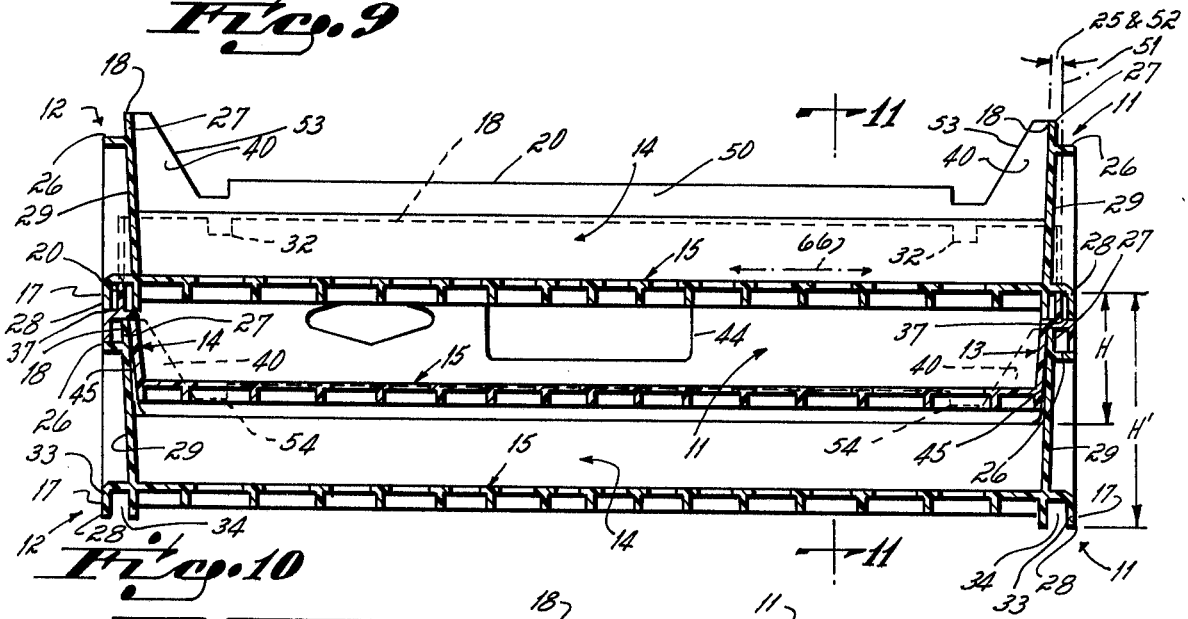
Figure 11:
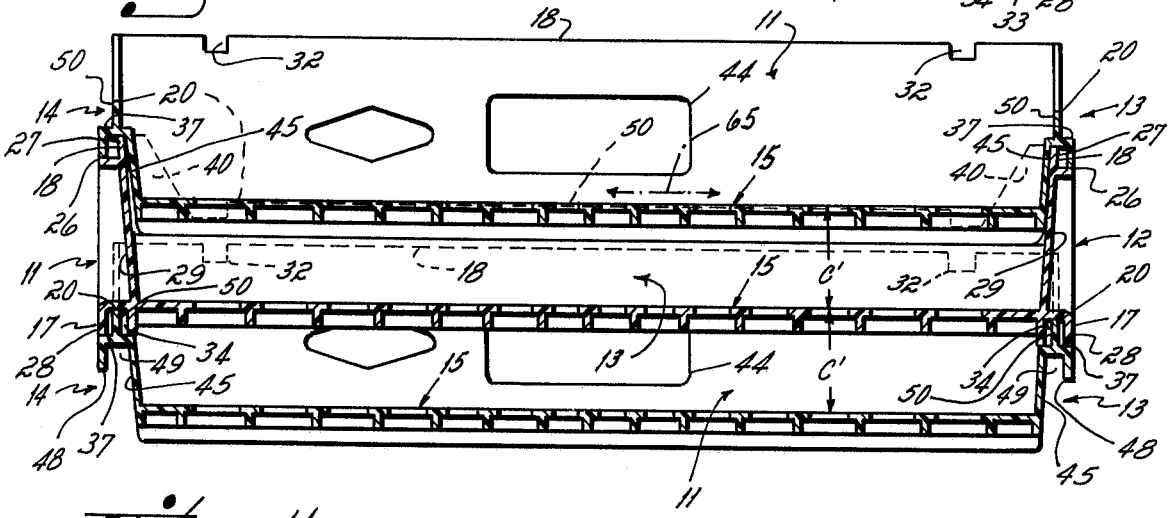

FIG. 10 is a cross-sectional view taken along line 10—10 of FIG. 9 and line 10—10 of FIG. 4; and FIG. 11 is a cross-sectional view taken along line 11—11 of FIG. 4, and line 11—11 of FIG. 10.

Figure 1:
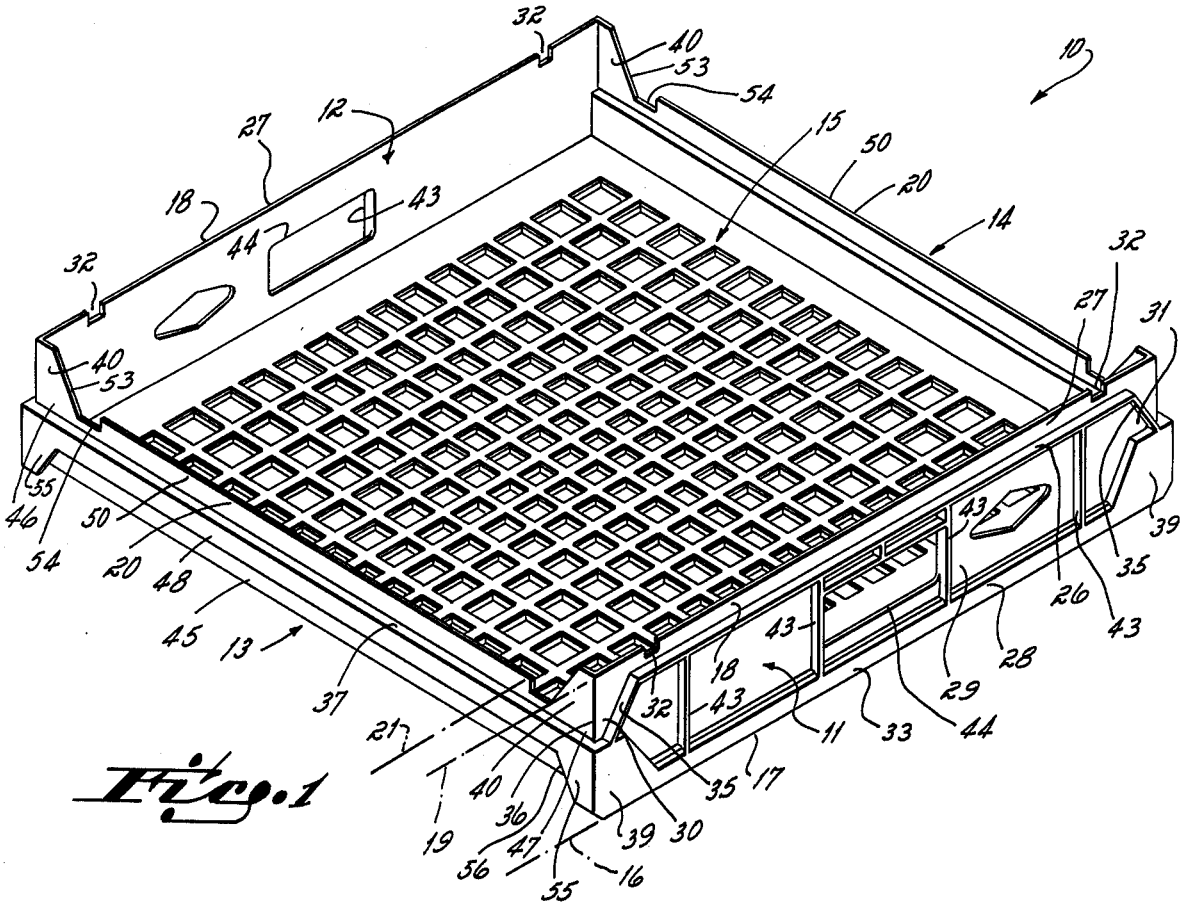
FIG. 1 is a top perspective view illustrating a tray in accord with the principles of this invention taken from one corner of that tray.
Figure 2:
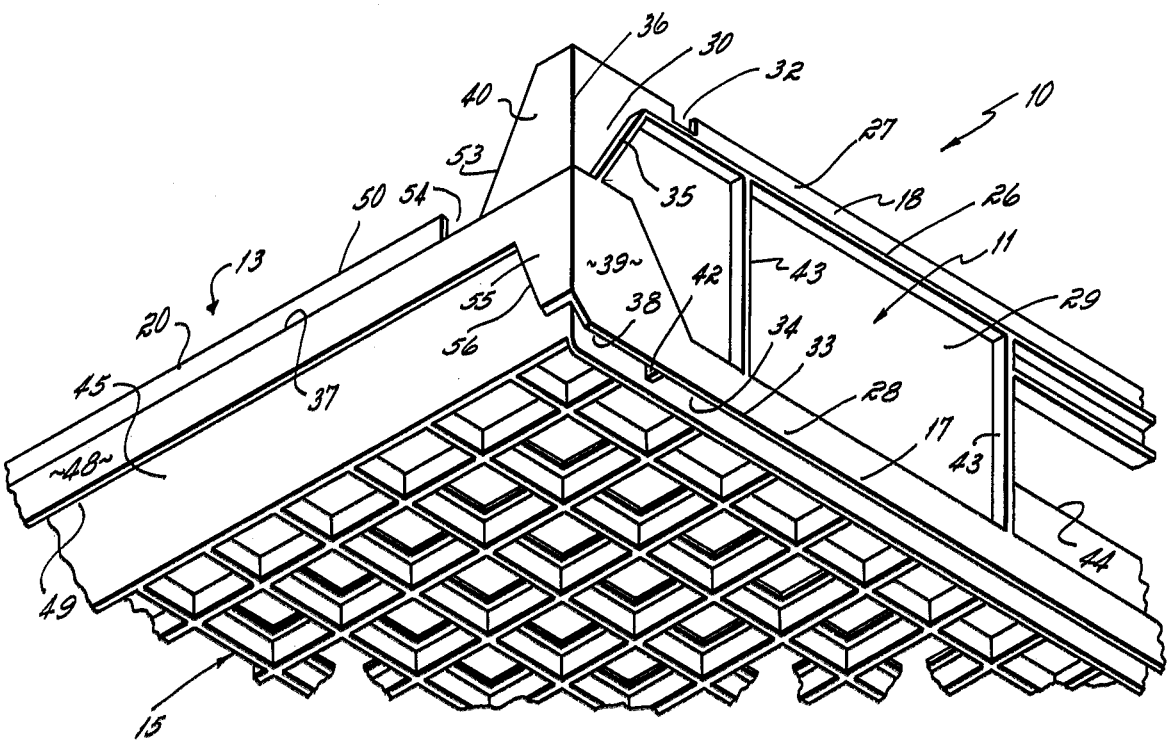
FIG. 2 is a view similar to FIG. 1, but illustrating a bottom perspective view of the tray taken from the same tray corner as that view of FIG. 1.
Figure 3:
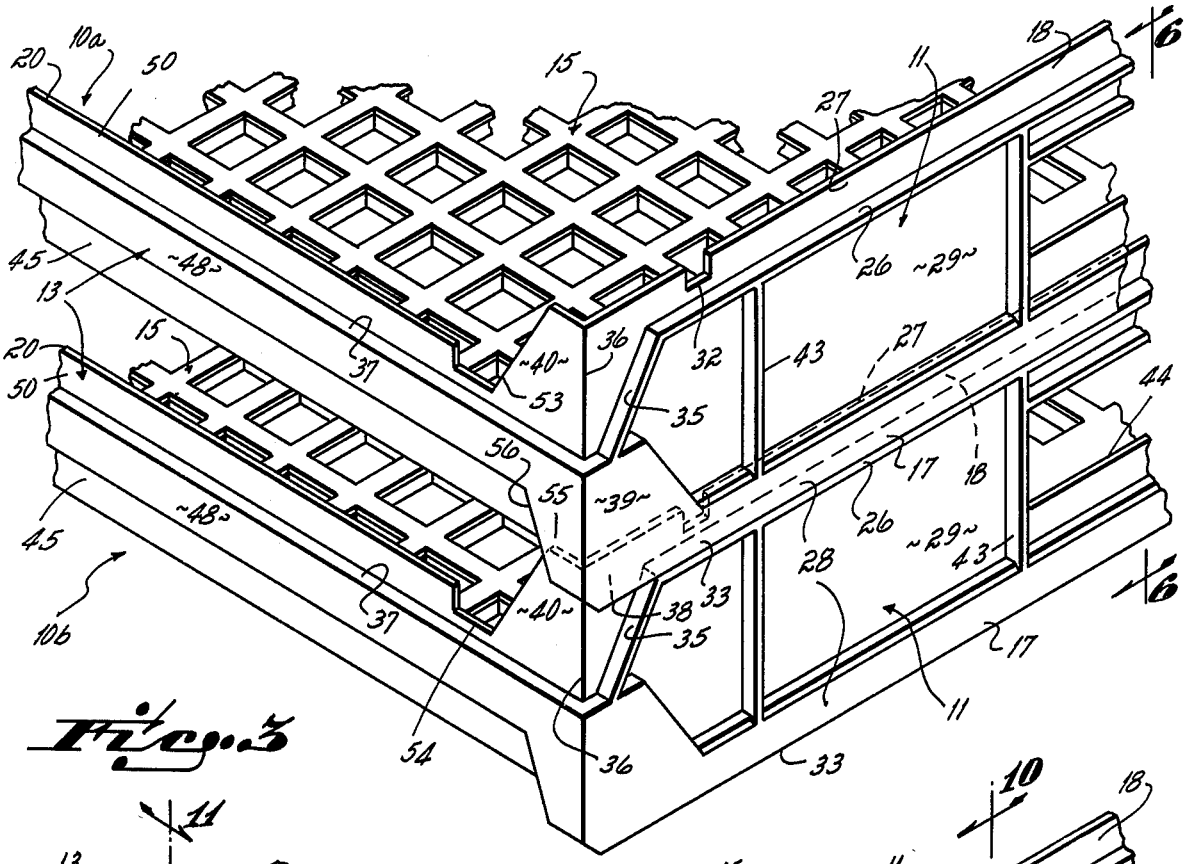
FIG. 3 is a top perspective view illustrating two trays, each in accord with the principles of this invention, in stacked relation one with another.

An improved and novel tray 10 in accord with the principles of this invention is illustrated generally in FIG. 1. As shown in that Figure, the tray 10 includes opposed side walls 11, 12, opposed end walls 13, 14, and floor 15, and is of a square configuration. All of the side 11, 12 and end 13, 14 walls extend upward from the floor 15, the floor being located closely adjacent the bottom plane 16 of the tray as defined by the side walls' bottom edges 17. The height H of the tray's end walls 13, 14 is only about one-half the height H' of the tray's side walls. In other words, the top edges 18 of the side walls 11, 12 define a top horizontal plane 19 and the top edges 20 of the end walls 13, 14 define a middle horizontal plane 21, the middle plane 21 being about mid-way between the top 19 and bottom 16 planes. Thus, both the end walls 13, 14 do extend above the floor 15 a discrete distance even though the side walls 11, 12 extend above that floor a distance more than twice as great. The opposed side walls 11, 12 are of identical structure one with the other, and the opposed end walls, 13, 14 are of identical structure one with the other. However, the end walls 13, 14 differ substantially and significantly in structural detail from that of the side walls 11, 12 as is explained in greater detail below.

As to each side wall 11, 12, note the wall itself angles or slants slightly outward relative to the vertical (see FIGS. 6 and 10) from its juncture with the tray's floor 15 to the top edge 18 thereof. This outward slanting of the side walls may be at an angle 25 to the vertical equal to about 2°. Each side wall 11, 12 also includes a top rail 26 and top rib 27 along the top edge 18 thereof, and a bottom rail 28 along the bottom edge 17 thereof. As shown in the Figures, the top 26 and bottom 28 rails extend outwardly from the exterior face 29 of the side wall, those rails being linear, being parallel one to the other, and extending from adjacent one end 30 to adjacent the other end 31 of the side wall. The bottom rail 28 includes a lip 33 that depends downwardly therefrom and spaced from the side wall, same cooperating with the bottom rail to define a bottom groove 34 of inverted U-shaped structural configuration. That portion of the side wall extending above the top rail 26 defines the top rib 27, the top rib being linear, being parallel to the top 26 and bottom 28 rails, and extending from one end 30 to the other end 31 of the side wall. The top rib 27 of the side wall includes slots 32 adjacent each end thereof, the purpose of which is explained in detail below. The top 26 and bottom 28 rails are, therefore, located on the exterior face of each side wall whereas the top rib 27 is, in effect, part of each side wall itself. Also, a plurality of vertical strength ribs 43 are preferably molded integral with each side wall, those strength ribs being interposed between the top rail 26 and the bottom rail 28, all of which cooperate to provide structural rigidity to the side wall. A hand port 44 is defined in each of the side walls substantially centrally thereof, the hand ports providing hand grips so the tray may be manually lifted by a user.

The top rail 26 on each side wall 11, 12 terminates, at each end thereof, in a centering rail 35 mounted on the exterior face 29 of the side wall, that centering rail extending downwardly in an angled fashion toward the adjacent corner 36 of the tray. The centering rail 35 intersects with a middle rail 37, explained in greater detail below, which, in effect, extends around onto the side wall from the end wall adjacent that corner where the centering rail is located. The centering rail 35, therefore, terminates at its bottom end closely adjacent the middle plane 21 of the tray. The bottom rail 28 on each side wall 11, 12 terminates, at each end thereof, in a pocket 38 defined by pocket wall 39 formed integral with the side wall but spaced therefrom, the pocket wall being coplanar with the bottom rail's lip 33. The pocket 38 is adapted to receive and enclose a stop flange 40, the stop flange being a portion of an end wall as explained in greater detail below, when upper and lower trays are nested. Further, the bottom rail 28, adjacent each end thereof and in a vertical plane 41 that includes a slot 32, includes a tab 42 located within the bottom rail's groove 34.

The end walls 13, 14 of the novel tray, as previously mentioned, are also identical one with the other. Note that, as illustrated in FIGS. 10 and 11, the end walls 13, 14 are angled or slanted slightly outward relative to a vertical plane 51 extending upward from the joinder of each end wall with the tray's floor, the angle 52 so formed being the same as the angle 25 of the side walls 11, 12. A linear middle rail 37 extends on the exterior face 45 of each end wall from one end 46 to the other 47. The middle rail 37 cooperates with a downwardly turned lip 48 mounted on the middle rail 37, the lip 48 being spaced from the end wall so as to define an inverted groove 49 of generally U-shaped cross section. A middle rib 50 extends upwardly from the middle rail 37, the linear rib, in effect, forming part of the end wall. But, note particularly that the rib is located in a plane 51 centrally disposed between the end wall per se and the middle rail's dowawardly depending lip 48, see particularly FIGS. 10 and 11. A stop flange 40 is located in the same vertical plane 51 as the end wall's rib 50 at each end of the end wall, and extends upwardly above the middle rib 50 to join the adjacent side wall so as to define a corner 36 of the tray. Each stop flange 40 includes a downwardly angled inner edge 53 which cooperates with the end wall rib 50 to define slot 54. Each end wall also includes a centering flange 55 at each end thereof, the centering flange being in the plane of the middle rail's lip 48, i.e., being spaced from the end wall. Each centering flange 55 includes a cam edge 56 adapted to cooperate with a side wall's centering rail 35 as explained in greater detail below. The centering flange 55 is formed integral with the pocket wall 39 adjacent pocket 38 on the adjacent side wall since both the pocket wall 39 and centering flange 55 are spaced equal distances from their respective side and end walls. Thus, each end wall includes a middle rail 37 disposed on the exterior face 45 thereof adjacent the top edge thereof, and also includes a middle rib 50 in a plane centrally disposed relative to that middle rail. The middle rail 37, middle rail's lip 48, stop flanges 40, and centering flanges 55 on each end wall all cooperate to promote structural rigidity for that wall.

In use, in the stacked attitude an upper **10*a* and a lower 10*b* tray are stacked as illustrated in FIGS. 3 and 5–8. As shown in those Figures, when stacked the upper tray 10*a* and the lower tray 10*b* define a clearance C between the upper tray's floor and the lower tray's floor. To orient the trays in this stacked attitude the upper tray's side walls and the lower tray's side walls are disposed coplanar one with the other, i.e., oriented in the same general vertical plane, on each side of the trays. In the stacked attitude, the upper tray's bottom rail 28 is seated on the lower tray's top rib 27, i.e., is received in the lower tray's groove 34, on each side thereof, as illustrated particularly in FIG. 6. In other words, the upper tray's bottom rail 28 and lower tray's top rib 27 cooperate to structurally support the upper tray 10*a* with the lower tray 10*b* in the stacked attitude. As many square trays of identical configuration may be stacked one on top the other as desired by the user, even though only two trays are shown in stacked relation in FIGS. 3 and 5–8**.

Figure 6:
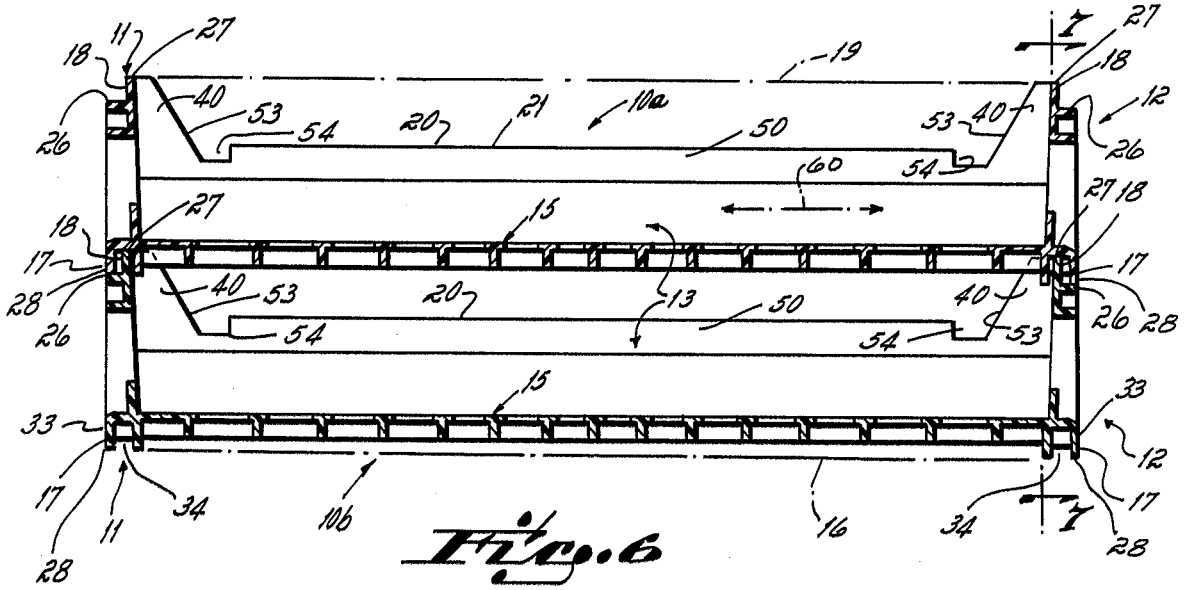
FIG. 6 is a cross-sectional view taken along line 6—6 of FIG. 5 and line 6—6 of FIG. 3.
Figure 7:
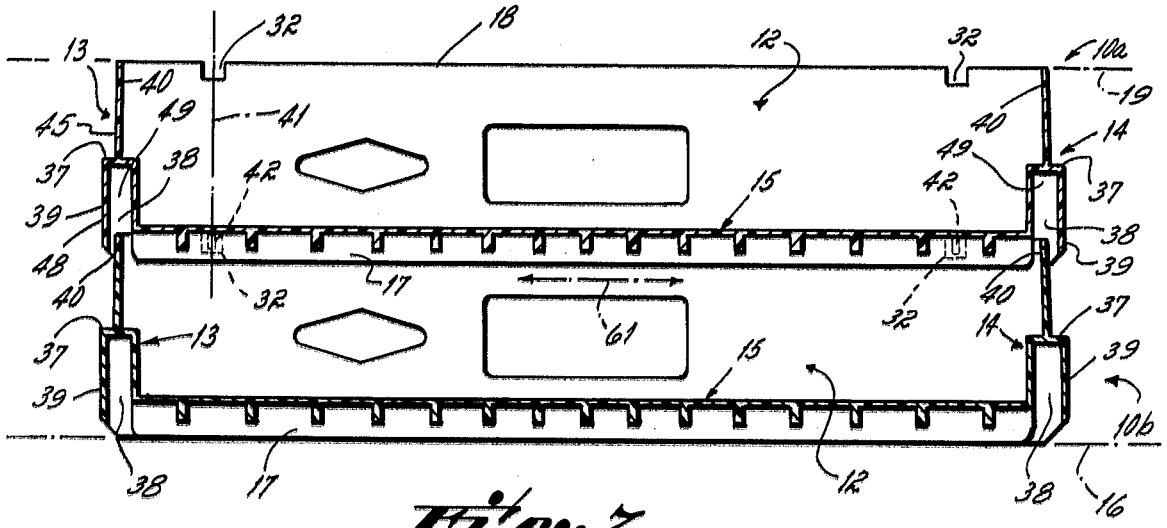
FIG. 7 is a cross-sectional view taken along line 7—7 of FIG. 6.

Side-to-side motion (as illustrated by phantom arrow 60) of the upper tray **10*a* relative to the lower tray 10*b*, as illustrated particularly in FIG. 6, is prevented by reason of the upper tray's side wall being received inside the lower tray's side walls on each side thereof due to the slanting or angling of those side walls as previously mentioned. In other words, facial contact of the upper tray's side wall at the bottom edge 17 thereof with the lower tray's side wall at the top edge 18 thereof, prevents significant side-to-side motion of two trays stacked one on top the other, see FIG. 6, thereby maintaining the trays in stacked relationship from a side-to-side relative motion 60 standpoint. The stacked trays are maintained in a stacked relationship from an end-to-end relative motion standpoint (see phantom arrow 61 indicating end-to-end relative motion) by virtue of tabs 42 in the upper tray's bottom grooves 34 being received in slots 32 in the lower tray's top ribs 27. Further, this end-to-end relative motion 61 of the upper tray 10***a* relative to the lower tray 10*b* is prevented by the end walls'stop flanges 40 being positioned outboard or exterior of the upper tray's end walls, see particularly FIG. 7. In other words, the upper tray's end walls are positioned between the lower tray's stop flanges 40, which stop flanges extend above the lower tray's end walls, that abutting relation preventing end-to-end motion 61 of the upper tray 10*a* relative to the lower tray 10*b*. Thus, the tab 42 and slot 32 relation between the upper tray and lower tray, as well as the pocket flange 40 and end wall relation of the upper tray to the lower tray, both cooperate to limit or prevent significant end-to-end relative motion 61 between the upper tray and the lower tray.

When it is desired to nest the trays relative one to the other, each tray is rotated 90° relative to the other so as to present the side walls in coplanar relation with the end walls, all as illustrated in FIGS. 4, 9–11. When nested, a pair of trays 10*a* and 10*b* define a clearance C′ between the upper tray's floor and the lower tray's floor, which clearance C′ is about one-half the clearance C between the upper tray's floor and the lower tray's floor when those trays are stacked, compare FIG. 8 to FIG. 9. In this nested attitude, the upper tray's bottom rails 20 are received in seated relation on the lower tray's middle ribs 50, see FIG. 11. Also in the nested attitude, the upper tray's middle rails 37 are seated on the lower tray's top ribs 27, and the upper tray's end walls are telescoped or located interiorly of the lower tray's side walls, see FIGS 10 and 11. The interrelationship of the upper tray's end walls with the lower tray's side walls, as illustrated in FIG. 11, prevent side-to-side motion (as illustrated by phantom arrow 65) of the upper tray relative to the lower tray when those trays are in the nested relation. Further, the seated relation of the upper tray's bottom rails 28 on the lower tray's middle ribs 50, as illustrated in FIG. 10, prevents end-to-end motion (as illustrated by phantom arrow 66) of the upper tray relative to the lower tray when those trays are in the nested relation.

Importantly, and with regard to the nested attitude, when one tray is turned 90° relative to the other tray the upper tray's centering flanges 55 are adapted to cooperate with the lower tray's centering rails 37 so as to guide the upper tray into the nested relation with the lower tray when the upper tray is lowered onto the lower tray, see FIGS. 4 and 9. In other words, the cam edges 56 of the upper tray's centering flanges 55 cooperate with the lower tray's centering rails 35 when the upper tray is lowered onto the lower tray so as to properly nest the upper tray relative to the lower tray. Further, also importantly, when the trays are nested, the stop flanges 40 of the lower tray are received in the pockets 38 defined on the exterior of the upper tray's side walls. The capturing of the lower tray's stop flanges 40 in the upper tray's pockets 38 also serves to prevent end-to-end motion 66 of the upper tray relative to the lower tray. The slots 54 in the end walls'middle ribs 50 of the lower tray receive tabs 42 in the bottom grooves 34 of the upper tray's side walls when the trays are nested.

Having described in detail the preferred embodiment of my invention, what I desire to claim and protect by Letters Patent is:

1. An improved square tray structure comprising a pair of opposed end walls and a pair of opposed side walls, said end walls being of a height about one-half that of said side walls, and said end walls and side walls defining a tray structure of square configuration, a floor, said end walls and said side walls all extending up from said tray's floor, a top rail and a top rib extending along the top edge of each of said side walls, and a bottom rail extending along the bottom edge of each of said side walls, and a middle rail and a middle rib extending along the top edge of each of said end walls, the side walls of upper and lower trays being stackable one on another so that the upper tray's bottom rails seat on the lower tray's top ribs and rails on each side thereof for supporting said trays in stacked relation and for preventing side-to-side relative motion between said trays when in stacked relation, said stacked trays having a generally square cross section when in stacked relation with said square cross section being dimensionally the same as the square configuration for each tray in that stack, and the upper and lower trays being nestable one on another in a position where the upper tray is rotated 90° relative to the lower tray from the stacked position so that the upper tray's bottom rails seat on the lower tray's middle ribs and rails, and so that the upper tray's middle rails seat on the lower tray's middle ribs and rails, and so that the upper tray's middle rails seat on the lower tray's upper ribs, for supporting said trays in nested relation and for preventing end-to-end motion between said trays when in nested relation, said nested trays having a generally square cross section when in nested relation with said square cross section being dimensionally the same as the square configuration for each tray in that nest.

2. An improved tray structure as set forth in claim 1 wherein all of said ribs and rails are linear and extend adjacent one end to adjacent the other end of that wall which each serves.

3. An improved tray structure as set forth in claim 1 wherein each of said walls slant slightly outward from the vertical relative to the joinder of that wall with said floor.

4. An improved tray structure as set forth in claim 3 wherein an upper tray's side walls are positioned inside a lower tray's ribs when the upper tray and the lower tray are stacked one on top the other, thereby preventing relative side-to-side motion between the trays when in the stacked relation.

5. An improved tray structure as set forth in claim 3 wherein an upper tray's end wall is positioned inside a lower tray's side wall when the trays are nested one on top the other, thereby preventing side-to-side relative motion between the trays when in the nested relation.

6. An improved tray structure as set forth in claim 3 wherein an upper tray's side walls are positioned inside a lower tray's middle ribs when the upper and lower trays are nested one on top the other, thereby preventing end-to-end relative motion between the trays when in the nested relation.

7. An improved tray structure as set forth in claim 1 including a stop flange extending upwardly from each end wall at each end thereof, the stop flanges on a lower tray being adapted to cooperate with the end walls on an upper tray to prevent end-to-end relative motion between the upper and lower trays when said trays are stacked one on top another.

8. An improved tray structure as set forth in claim 7 including a pocket defined on the exterior face of each side wall at each end thereof, each pocket being adapted to receive a stop flange therein when an upper tray and a lower tray are nested one within another.

9. An improved tray structure as set forth in claim 1 including a centering flange mounted on each end wall at each end thereof, said centering flange being spaced outward from and parallel to said end wall, and said centering flange defining a cam edge thereon, and a centering rail mounted on each side wall at each end thereof, said centering rail being connected with said top rail and angling downward therefrom, said centering flanges and said centering rails cooperating one with another upon nesting of an upper tray with a lower tray to aid in centering the upper tray on the lower tray in the nested relation.

10. An improved tray structure as set forth in claim 1 including at least one tab mounted on a side wall on the exterior face thereof, said tab extending downward from said bottom rail, and at least one notch in said top rib on a side wall, said notch being sized to receive said tab, said tab and said notch being interengaged when an upper tray is stacked on top a lower tray to prevent end-to-end motion of said upper tray relative to said lower tray.

11. An improved square tray structure comprising a pair of opposed end walls and a pair of opposed side walls, said end walls being of a height about one-half that of said side walls, and said end walls and side walls defining a tray structure of square configuration, a floor, said end walls and said side walls all extending up from said tray's floor, a top rail and a top rib extending along the top edge of each of said side walls, and a bottom rail extending along the bottom edge of each of said side walls, a middle rail and a middle rib extending along the top edge of each of said end walls, the side walls of upper and lower trays being stackable one on another so that the upper tray's bottom rails seat on the lower tray's top ribs and rails on each side thereof for supporting said trays in stacked relation, said stacked trays having a generally square cross section when in stacked relation, with said square cross section being dimensionally the same as the square configuration for each tray in that stack, the upper trays being nestable one on another in a position where the upper tray is rotated 90° relative to the lower tray from the stacked position so that the upper tray's bottom rails seat on the lower tray's middle ribs and rails, and so that the upper tray's middle rails seat on the lower tray's upper ribs, for supporting said trays in nested relation, said nested trays having a generally square cross section when in nested relation with said square cross section being dimensionally the same as the square configuration for each tray in that nest, and a stop flange extending upwardly from each end wall at each end thereof, the stop flanges on a lower tray being adapted to cooperate with the end walls on an upper tray to prevent end-to-end relative motion between the upper and lower trays when said trays are stacked one on top another.

12. An improved tray structure as set forth in claim 11 including a pocket defined on the exterior face of each side wall at each end thereof, each pocket being adapted to receive a stop flange therein when an upper tray and a lower tray are nested one within another.

13. An improved tray structure as set forth in claim 11 including a centering flange mounted on each end wall at each end thereof, said centering flange being spaced outward from and parallel to said end wall, and said centering flange defining a cam edge thereon, and a centering rail mounted on each side wall at each end thereof, said centering rail being connected with said top rail and angling downward therefrom, said centering flanges and said centering rails cooperating one with another upon nesting of an upper tray with a lower tray to aid in centering the upper tray on the lower tray in the nested relation.

14. An improved tray structure as set forth in claim 11 including at least one tab mounted on a side wall on the exterior face thereof, said tab extending downward from said bottom rail, and at least one notch in said top rib on a side wall, said notch being sized to receive said tab, said tab and said notch being interengaged when an upper tray is stacked on top a lower tray to prevent end-to-end motion of said upper tray relative to said lower tray.

15. An improved square tray structure comprising a pair of opposed end walls and a pair of opposed side walls, said end walls being of a height about one-half that of said side walls, a floor, said end walls and said side walls all extending up from said tray's floor, a top rail and a top rib extending along the top edge of each of said side walls, and a bottom rail extending along the bottom edge of each of said side walls, a middle rail and a middle rib extending along the top edge of each of said end walls, the side walls of upper and lower trays being stackable one on another so that the upper tray's bottom rails seat on the lower tray's top ribs and rails on each side thereof for supporting said trays in stacked relation, said stacked trays having a generally square cross section when in stacked relation with said square cross section being dimensionally the same as the square configuration for each tray in that stack, the upper and lower trays being nestable one on another in a position where the upper tray is rotated 90° relative to the lower tray from the stacked position so that the upper tray's bottom rails seat on the lower tray's middle ribs and rails, and so that the upper tray's middle rails seat on the lower tray's upper ribs, for supporting said trays in nested relation, said nested trays having a generally square cross section when in nested relation with said square cross section being dimensionally the same as the square configuration for each tray in that nest, a centering flange mounted on each end wall at each end thereof, said centering flange being spaced outward from and parallel to said end wall, and said centering flange defining a cam edge thereon, and a centering rail mounted on each side wall at each end thereof, said centering rail being connected with said top rail and angling downward therefrom, said centering flanges and said centering rails cooperating one with another upon nesting of an upper tray with a lower tray to aid in centering the upper tray on the lower tray in the nested relation.

16. An improved tray structure as set forth in claim 15 including a stop flange extending upwardly from each end wall at each end thereof, the stop flanges on a lower tray being adapted to cooperate with the end walls on an upper tray to prevent end-to-end relative motion between the upper and lower trays when said trays are stacked one on top another.

17. An improved tray structure as set forth in claim 16 including a pocket defined on the exterior face of each side wall at each end thereof, each pocket being adapted to receive a stop flange therein when an upper tray and a lower tray are nested one within another.

18. An improved tray structure as set forth in claim 15 including at least one tab mounted on a side wall on the exterior face thereof, said tab extending downward from said bottom rail, and at least one notch in said top rib on a side wall, said notch being sized to receive said tab, said tab and said notching being interengaged when an upper tray is stacked on top a lower tray to prevent end-to-end motion of said upper tray relative to said lower tray.

* * * * *